US006508170B2

(12) United States Patent
Katsuoka et al.

(10) Patent No.: US 6,508,170 B2
(45) Date of Patent: Jan. 21, 2003

(54) LITHOGRAPHIC PLATE MATERIALS AND METHOD FOR MAKING LITHOGRAPHIC PLATES USING THE SAME

(75) Inventors: Toshimichi Katsuoka, Tokyo (JP); Junichi Nouda, Tokyo (JP); Hironori Sato, Ohmiya (JP)

(73) Assignee: Kimoto Co., Ltd. (JP)

( * ) Notice: Subject to any disclaimer, the term of this patent is extended or adjusted under 35 U.S.C. 154(b) by 0 days.

(21) Appl. No.: 09/814,112

(22) Filed: Mar. 22, 2001

(65) Prior Publication Data

US 2001/0035105 A1 Nov. 1, 2001

(30) Foreign Application Priority Data

Mar. 23, 2000 (JP) ..... 2000-082205

(51) Int. Cl.[7] ..... B41N 1/14; B41N 3/08

(52) U.S. Cl. ..... 101/455; 101/457; 101/462; 101/465

(58) Field of Search ..... 101/453, 454, 101/457, 458, 459, 462, 463.1, 465, 466, 455; 430/302

(56) References Cited

U.S. PATENT DOCUMENTS 4,976,198 A * 12/1990 Ohba et al. ..... 101/459
5,368,931 A * 11/1994 Kato et al. ..... 101/457
5,501,150 A * 3/1996 Leenders et al. ..... 101/466
5,714,250 A * 2/1998 Kato et al. ..... 101/458
5,996,497 A * 12/1999 DeBoer et al. ..... 101/463.1
6,019,045 A * 2/2000 Kato et al. ..... 101/466
6,098,545 A * 8/2000 Kato ..... 101/465
6,283,029 B1 * 9/2001 Tashiro et al. ..... 101/466
6,357,351 B1 * 3/2002 Bhambra et al. ..... 101/460

* cited by examiner

*Primary Examiner*—Stephen R. Funk
(74) *Attorney, Agent, or Firm*—Lorusso & Loud

(57) ABSTRACT

There is provided a lithographic plate material which can be desensitized by distilled water or a fountain solution used for other lithographic plates, without desensitizing using an etching solution, and with less scumming in non-image portions of the print. The lithographic plate material has an image-receptive layer formed on a support and containing polyvinyl alcohol cross-linked by tetra alkoxy silane hydroxylate, titanium oxide microparticles, and silica having an average particle size of 1 nm to 100 nm. The image-receptive layer has a surface with an arithmetic mean roughness of not less than 0.40 $\mu$m and less than 1.20 $\mu$m, a contact angle of less than 50 degrees with distilled water at room temperature, and ink-receptiveness for hot-melt and lipophilic ink.

9 Claims, No Drawings

LITHOGRAPHIC PLATE MATERIALS AND METHOD FOR MAKING LITHOGRAPHIC PLATES USING THE SAME

BACKGROUND OF THE INVENTION

1. Field of the Invention

The present invention relates to a lithographic plate material with an image-receptive layer capable of providing water retention characteristics suitable for a lithographic fountain solution without desensitizing. In particular, it relates to a lithographic plate material capable of forming lipophilic images using an ink-jet printer with hot-melt type solid ink.

2. Related Art

Lithographic printing using a lithographic printing plate is widely used for printing a small number of printed items, e.g., less than ten thousand. Conventionally, the lithographic printing plates are made by forming an image-receptive layer on a substrate such as a waterproof paper and printing a lipophilic image on the image-receptive layer using a typewriter or making a copy of an original block copy using a dry elecrophotography copier to form lipophilic images of toner on the image-receptive layer.

With the recent development of computers and peripheral devices, plate making processes using various kinds of digital printers have been proposed. For example, Japanese patent application laid-open Nos. 6-138719 (94), 6-250424 (94) and 7-1847 (95) disclose methods for making a lithographic printing plate by forming toner images on an image-receptive layer using a dry-type electrophotography laser printer.

The inventions disclosed in the aforementioned patent applications are directed to reduction of scumming in non-image portions of a print, which is likely to occur when dry-type electrophotography laser printers are used, and to obtain a lithographic plate having excellent plate wear.

Japanese patent application laid-open No.9-58144 (97) discloses a method of making a lithographic plate which does not use the dry-type electrophotography laser printer having such a drawback but, rather, forms lipophilic images on an image-receptive layer using an ink-jet printer with a hot-melt type solid ink.

However, the image-receptive layer of the lithographic plate disclosed in the above-mentioned patent application contains zinc oxide and a polymer binder as main components and, therefore, it is necessary to sufficiently desensitize the zinc oxide at the surface of the image-receptive layer in order to impart sufficient water retention to enable application of lithography to the image-receptive layer by means of an etching process using a cyan-system etching solution containing phosphoric acid/potassium ferricyanide as a main component or a non-cyan system etching solution containing phytic acid as a main component.

Despite efforts to improve image-receptive layers or printing methods using digital printers to reduce generation of scumming in non-image portions of a print, insufficient desensitization is achieved in the plate making process due to degradation of the aforementioned etching solution and lowering of the liquid temperature and, as a result, scumming occurs.

In addition, a printing process using the lithographic plate disclosed in the above-mentioned application requires a special fountain solution containing components similar to those of the etching solution. As a result, when the plate is used together with another lithographic plate such as an aluminum graining presensitized (PS) plate and/or lithographic plate made by a silver salt diffusion transfer process, the fountain solution in the lithographic press has to be changed. This makes printing more problematic.

The present invention aims at solving the abovementioned problems. Specifically, an object of the present invention is to provide a lithographic plate material which can be desensitized with distilled water or a fountain solution used for other lithographic plates, without using an etching solution, and to reduce scumming in non-image portions of the printed product. Another object of the present invention is to provide a method of making a lithographic plate using the novel lithographic plate material.

SUMMARY OF THE INVENTION

The lithographic plate material of the present invention comprises a support and an image-receptive layer formed on the support, wherein the surface of the image-receptive layer has an arithmetic mean roughness defined by JIS (Japanese Industrial Standard)-B0601 of not less than 0.40 $\mu$m and less than 1.20 $\mu$m, a contact angle with distilled water at room temperature of less than 50 degrees, and the image-receptive layer has ink-receptiveness for hot-melt and lipophilic ink.

The lithographic plate material of the present invention has an image-receptive layer, a hydrophilic polymer binder and inorganic microparticles.

Preferably, the lithographic plate material of the present invention has an image-receptive layer comprising polyvinyl alcohol cross-linked by hydroxylate of tetra-alkoxy silane, titanium oxide microparticles, and silica having an average primary particle size of from 1 nm to 100 nm and/or alumina having an average primary particle size of from 1 nm to 100 nm.

The lithographic plate material of the present invention may further include an undercoat layer between the support and the image-receptive layer. In this lithographic plate material, the undercoat layer may contain inorganic microparticles or synthetic resin microparticles.

The method of making a lithographic plate of the present invention comprises forming lipophilic images on the image-receptive layer of the lithographic plate material using hot-melt and lipophilic ink.

The method of making a lithographic plate of the present invention may further include imparting water retention characteristics for a lithographic fountain solution to the surface of the image-receptive layer without a desensitizing process.

The method of making a lithographic plate of the present invention may form lipophilic images on the image-receptive layer using an ink-jet printer with hot-melt solid ink.

PREFERRED EMBODIMENT OF THE INVENTION

Preferred embodiments of the present invention will be explained in detail hereinafter. In the following explanation, "part" and "%" are used on a weight basis unless otherwise indicated.

The lithographic plate material of the present invention comprises a support and an image-receptive layer formed on the support.

As the support, a plastic film composed of a resin such as polyethylene, polypropylene, polyvinylchloride, polystyrene, polyethylene-terephthalate, waterproof paper having such a plastic film laminated thereon or waterproof paper coated with such a resin can be used.

A polyethylene-terephthalate film is particularly preferred in view of its mechanical strength, dimensional stability, resistance to chemicals, and waterproof property. The support may include a light-shielding pigment such as carbon black or titanium oxide in order to make it light-shielding. The thickness of the support may be not less than 50 μm and less than 300 μm.

In order to improve adhesiveness to the image-receptive layer, the support is preferably exposed to far ultraviolet rays, or subjected to a plasma process, a corona discharge process or, preferably, an undercoating process.

Materials of the undercoat depend on the type of support employed. When polyethylene-terephthalate film is employed, it may be formed by applying a coating solution containing isocyanate prepolymer dissolved in a resin selected from acetal resins such as polyvinylbutyral, polyester resins having a terminal hydroxyl group and acrylic copolymers having side chain with a terminal hydroxyl group, to the support so that the undercoat has a dry thickness of not less than 0.5 μm and less than 10 μm.

To improve adhesiveness between the support and the image-receptive layer and to adjust the surface roughness of the image-receptive layer to be laminated thereon, the undercoat may contain inorganic microparticles such as calcium carbonate, barium sulfate, silica, zinc oxide, titanium oxide, clay, alumina or synthetic resin microparticles such as acrylic resin, epoxy resin, nylon resin, polyethylene resin, fluorine resin, or benzoguanamine, in an amount of not less than 5 parts and less than 200 parts based on 100 parts of the binder resin of the undercoat.

Within the above-mentioned range, the surface of the undercoat can be roughened without lowering the film strength of the undercoat. This roughened surface affects the surface of the image-receptive layer and gives a preferred surface roughness to the surface of the image-receptive layer.

The coating solution for the undercoat can be prepared using, as occasion demands, known means for preparing a dispersion such as a ball mill, sand grinder, attritor, roll mill, or high-speed impeller dispersion mixer. The undercoat can be formed by applying the aforementioned coating solution on the support by means of a known coating method such as roll coating, bar coating, or blade coating with heat drying at a predetermined temperature.

The image-receptive layer prepared on a support is required to have an arithmetic mean surface roughness defined by JIS-B0601 of not less than 0.40 μm and less than 1.20 μm in order to have an ink-receptiveness for hot-melt solid ink. In addition to the surface roughness of the aforementioned range, it is also required to have a contact angle of less than 50 degrees to distilled water at room temperature in order to have water retention characteristics suitable for a lithographic fountain solution. Such an image-receptive layer consists of at least a hydrophilic polymer binder and inorganic microparticles.

Examples of the hydrophilic polymer binder include polyvinyl alcohol, carboxymethyl cellulose, hydroxyethyl cellulose, polyvinylpyrrolidone, and methylvinyl ether/maleic anhydride copolymer. Completely saponified polyvinyl alcohol having a polymerization degree of less than 1000 and a saponification degree of 97 mol% or more is preferred since inorganic microparticles can be dispersed therein very well during preparation of the coating solution of the image-receptive layer and because it can be cross-linked by a tetra alkoxy silane hydroxylate, which will be explained hereinafter.

The tetra alkoxy silane used in the present invention can be obtained by allowing silane tetra chloride, which is a reaction product of metallic silicon (a reduction product of silica) and chlorine, to react with alcohol. The tetra alkoxy silane is further hydrolyzed in a mixture of water and alcohol, such as ethanol, isopropanol, or ethyl cellosolve in the presence of a catalyst acidified with HCl to provide the hydroxylate.

The tetra alkoxy silane hydroxylate functions as a crosslinker of the polyvinyl alcohol contained in the image-receptive layer through a silanol group included in its molecule and thereby makes the image-receptive layer waterproof and imparts thereto suitable water retention characteristics.

The amount of the tetra alkoxy silane hydroxylate added to the polyvinyl alcohol is preferably 20 parts or more and less than 200 parts based on 100 parts of polyvinyl alcohol in terms of the amount of tetra alkoxy silane before hydrolysis. With an amount of 20 parts or more, an excellent waterproof property can be obtained. With an amount of less than 200 parts, degradation of water retention characteristics suitable for a lithographic fountain solution can be prevented and generation of scumming in non-image portions of printed products can be reduced.

In order to further improve water retention and waterproof characteristics and mechanical strength, water soluble resins such as carboxymethyl cellulose, hydroxyethyl cellulose, polyvinylpyrrolidone, and methylvinylether/maleicanhydride copolymer, and emulsions of homopolymers or copolymers of vinyl chloride, vinyl acetate, acrylic ester, ethylene, styrene and the like can be added to the polyvinyl alcohol in an amount of less than 30 parts based on 100 parts of the polyvinyl alcohol.

With an amount less than 30 parts, water retention and waterproof characteristics and mechanical strength can be improved without impairing the characteristics of the polyvinyl alcohol. The aforementioned emulsion can be a complex with colloidal silica or the like so as to further improve the water retention, water proof characteristics and mechanical strength of the image-receptive layer.

Examples of inorganic microparticles used in the present invention include calcium carbonate, barium sulfate, silica, titanium oxide, clay, alumina and the like. In order to impart ink-receptiveness for hot-melt and lipophilic ink, water retention characteristics and mechanical strength to the image-receptive layer, it is preferred to use a combination of titanium-oxide microparticles and silica having a primary particle size of not less than 1 nm and less than 100 nm and/or alumina having a primary particle size of not less than 1 nm and less than 100 nm, which have good adhesiveness to hot-melt and lipophilic ink, show good water retention between molecules and are excellent in mechanical strength.

The titanium-oxide microparticles are prepared by the sulfuric-acid method or chlorine method. The crystalline form may be a rutile form or an anatase form. The average particle size may be not less than 0.05 μm and less than 1.0 μm. The surface of the particles may be processed with alumina or silica to become hydrophilic.

The amount of the titanium oxide is 50 parts or more, and preferably 100–1000 parts, preferably less than 800 parts, based on 100 parts of the polymer binder included in the image-receptive layer.

Within these ranges of average particle size and amount, the image-receptive layer can have an arithmetic mean surface roughness defined by JIS-B0601 of 0.40 μm or more and less than 1.20 μm to provide ink-receptiveness for hot-melt and lipophilic ink, water retention characteristics suitable for a fountain solution, waterproof property and mechanical strength.

A silica having a primary particle size of not less than 1 nm and less than 100 nm is anhydrous silica prepared by a dry process and having a hydrophilic surface with many silanol groups. The lower limit of the primary particle size is 1 nm, preferably 5 nm, and more preferably 10 nm. The upper limit is 100 nm, preferably 40 nm, and more preferably 20 nm. The BET specific surface area is not less than 40 $m^2/g$, and preferably 100 $m^2/g$–400 $m^2/g$, preferably less than 300 $m^2/g$.

Within these ranges, water retention suitable for a fountain solution can be improved without degrading adhesiveness of the image-receptive layer to hot-melt and lipophilic ink. The silica may be a mixed oxide of silica and alumina.

Alumina having a primary particle size of not less than 1 nm and less than 100 nm is also prepared by a dry process. The lower limit of the primary particle size is 1 nm, and preferably 10 nm. The upper limit is 100 nm, and preferably 40 nm. The BET specific surface area is preferably not less than 40 $m^2/g$ and less than 200 $m^2/g$.

Within the above ranges, adhesiveness of the image-receptive layer to hot-melt and lipophilic ink can be improved without degrading the water retention property of the image-receptive layer. Silica and alumina may be used alone or as a mixture.

The amount of silica and/or alumina is not less than 2 parts, and preferably not less than 5 parts and less than 200 parts, preferably less than 100 parts based on 100 parts of the polymer binder included in the image-receptive layer. Within this range of amounts, silica and/or alumina can be well dispersed in the coating solution for forming the image-receptive layer together with titanium oxide microparticles. Therefore, the coating solution can be applied easily. In addition, the image-receptive layer can have good water retention property, ink-receptiveness for hot-melt and lipophilic ink, waterproofness and mechanical strength.

As occasion demands, the image-receptive layer may contain inorganic microparticles such as calcium carbonate, barium sulfate, clay, silica and alumina having different particle sizes, and the like or synthetic resin microparticles such as acrylic resins, epoxy resins, nylon, polyethylene resins, fluororesins, and benzoguanamine resins, in an amount of not more than 100 parts based on 100 parts of the polymer binder included in the image-receptive layer. Silica having an average particle size of not less than 1 μm and less than 10 μm is particularly preferred since it gives fine irregularity to the surface of the image-receptive layer and improves water retention suitable for a fountain solution without degrading waterproofness.

The total amount of titanium oxide microparticles, silica and/or alumina having a primary particle size of not less than 1 nm and less than 100 nm, optional inorganic microparticles and synthetic resin microparticles is not less than 80 parts and preferably 100 to 1000 parts, preferably less than 800 parts, based on 100 parts of the polymer binder included in the image-receptive layer.

If the above amount is less than 80 parts, the image-receptive layer will not have sufficient surface irregularity and, therefore lipophilic images formed thereon by hot-melt solid ink will not adhere properly and tend to be removed during the printing process. This results in poor print durability. In addition, the image-receptive layer has insufficient water retention property for a fountain solution, which leads to generation of scumming in non-imaged portions of the printed product.

On the other hand, if the amount is 1000 or more parts, the surface of the image-receptive layer becomes too rough, and ink-receptiveness for lipophilic images by hot-melt solid ink becomes uneven. This results in low resolution and poor image reproducibility in the printed product. In addition, the film strength of the image-receptive layer is degraded and part of the layer is removed from the support during the printing process. This leads to generation of scumming and poor printing durability.

To form the image-receptive layer of the lithographic plate material of the present invention, an aqueous solution containing not less than 5% and less than 20% of the aforementioned solution of polyvinyl alcohol in distilled water is prepared, and titanium oxide microparticles, silica and/or alumina having a primary particle size of not less than 1 nm and less than 100 nm, optional inorganic microparticles and synthetic resin microparticles, water soluble resins, and homopolymer or copolymer resin emulsion are mixed therein. Then tetra alkoxy silane is added thereto to obtain a coating solution. The coating solution is applied to a support by means of a conventional coating method such as roll coating, bar coating, or blade coating to form a coating layer on the support. The coating layer is dried in an atmosphere of not less than 50° C. and less than 200° C. for 30 seconds to 10 minutes.

Optionally, the aforementioned coating solution for the image-receptive layer may be prepared using a known means for preparing a dispersion such as a ball mill, sand grinder, attritor, roll mill, or high-speed impeller dispersion mixer.

The lithographic plate material of the present invention may be provided with a low electric-resistance layer on the side opposite the aforementioned image-receptive layer. The low electric-resistance layer helps static chucking in an ink-jet printer using hot-melt solid ink, which will be explained later, and consequently the lithographic plate material of the present invention can be attached to a vertical mounting portion without a clamp or adhesive tape. In addition, since the lithographic plate material of the present invention adheres to the mounting portion, flatness of the lithographic plate can be kept without floating, and rubbing of the image receiving surface with a recording head can be prevented.

The low electric-resistance layer consists of an ion conductive acrylic resin obtained by copolymerization of a cationic monomer having quaternary ammonium-salt groups such as hydroxy propyltrimethyl ammonium chloride methacrylate and oxyethyl trimethyl ammonium chloride methacrylate, and a lipophilic monomer such as methyl methacrylate and butyl methacrylate.

The surface resistivity of the aforementioned low electric-resistance layer is preferably less than $10^{10}\Omega$. If surface resistivity is $10^{10}\Omega$ or more, the static mounting mechanism does not operate efficiently.

A method of making a lithographic plate of the present invention comprises providing the aforementioned lithographic plate material and forming lipophilic images on the image-receptive layer of the material using hot-melt and lipophilic ink.

To apply the hot-melt and lipophilic ink on the image-receptive layer, ink-jet printers using hot-melt type solid ink can be employed.

The ink-jet printer using hot-melt type solid ink is disclosed in "Electrophotography No.112 pp71–75 (Society of Electrophotography)" and "Japan Hardcopy '99, Literatures pp.347–350 (The Imaging Society of Japan)." The ink-jet printer forms lipophilic images by heating and liquefying solid ink, which is solid at room temperature, and ejecting recording dots toward the image-receptive layer.

The hot-melt type solid ink is composed mainly of a hot-melt compound, i.e. wax, which is solid at room temperature and liquefied by heating. In order to obtain suitable printing characteristics for ink-jet printing, it may further contain resins selected from polyamide resins, polyester resins, polyvinyl acetate resin and the like, and colorant. In addition, acrylate resins, urethane resins and the like may be added to the hot-melt type solid ink so that the ink adheres firmly to the image-receptive layer and mechanical strength, such as surface abrasion strength of the lipophilic images, chemical strength such as resistance to printing ink or a fountain solution, and affinity for the printing ink can be maintained.

According to the method of making a lithographic plate of the present invention, the surface of the image-receptive layer can be imparted with water retention using a lithographic fountain solution without desensitizing the layer. Consequently, a lithographic plate made from the material can be directly used in a lithographic press. As occasion demands, however, distilled water or a lithographic fountain solution may be applied to the image-receptive layer to prevent the plate surface from becoming stained.

EXAMPLES

Hereafter, the present invention will be explained with reference to the following examples.

Example 1

1. Coating Solution for Undercoat Layer

| | |
|---|---|
| Polyester resin having terminal hydroxyl groups (Elitel UE3201, Unichika, Ltd.) | 10 parts |
| Isocyanate prepolymer (solid content: 60%, Takenate D110N, Takeda Chemical Industries, Ltd.) | 2 parts |
| Silica (average particle size: 6 μm, Sylysia 770, Fuji-Silysia Chemical Ltd.,) | 1.5 parts |
| Toluene | 50 parts |
| Methyl ethyl ketone | 50 parts |

A mixture of the above materials was stirred for 1 hour to form a coating solution for forming the undercoat layer.

2. Coating Solution for Forming the Image-receptive Layer

| | |
|---|---|
| Titanium oxide microparticles (average particle size: 0.12 μm, FA55W, FURUKAWA CO., LTD.) | 30 parts |
| Silica (primary particle size: 12 nm, specific surface area according to BET method: 200 $m^2/g$, Aerosil 200, Nippon Aerosil Co., Ltd.) | 2 parts |
| Alumina (primary particle size: 13 nm, specific surface area according to BET method: 100 $m^2/g$, Aluminum Oxide C, Degussa-Huels Ltd.) | 1 part |
| Polyvinyl alcohol (10% aqueous solution, saponification degree: 98.5 mol % or more, polymerization degree: less than 1000, Gosenol NL05, The Nippon Synthetic Chemical Industry Co., Ltd.) | 100 parts |

-continued

| | |
|---|---|
| Isopropyl alcohol | 40 parts |
| Distilled water | 100 parts |

A mixture of the above materials was dispersed in a ball mill for 3 days.

To 200 parts of the obtained dispersion were added the following materials with stirring for 1 hour to prepare a coating solution for forming the image-receptive layer.

| | |
|---|---|
| Silica (average particle size: 6 μm, Sylysia 770, Fuji-Silysia Chemical Ltd.,) | 1 part |
| Tetraethoxysilane hydroxylate | 30 parts |

The tetraethoxysilane hydroxylate was obtained by mixing the following materials and allowing a hydrolysis reaction to proceed at room temperature for 24 hours.

| | |
|---|---|
| Tetraethoxysilane (reagent grade, Wako Pure Chemical Industries, Ltd.) | 100 parts |
| Ethanol | 100 parts |
| 0.1N hydrochloric acid aqueous solution | 200 parts |

3. Coating Solution for Forming the Low Electric-resistance Layer

| | |
|---|---|
| Ion-conductive acrylic resin solution (solid content: 35%, Saftomer STH-55, Mitsubishi Chemical Co.) | 30 parts |
| Silica (average particle size: 3 μm, Sylysia 730, Fuji-Silysia Chemical Ltd.,) | 1 part |
| Isopropyl alcohol | 50 parts |

A mixture of the above materials was stirred for 1 hour to prepare a coating solution for forming the low electric-resistance layer.

A white polyethylene terephthalate film having a thickness of 188 μm was coated with the coating solution for the undercoat layer using a Meyer bar and dried with hot air at 100° C. for 2 minutes to form an undercoat layer having a thickness of 5 μm.

Subsequently, the coating solution for the image-receptive layer was coated on the undercoat layer in a similar manner, and dried with hot air at 150° C. for 5 minutes to form an image-receptive layer having a thickness of 7 μm.

Further, the coating solution for the low electric-resistance layer was coated on the surface opposite that coated with the image-receptive layer in a similar manner, and dried with hot air at 100° C. for 2 minutes to form a low electric-resistance layer having a thickness of 2 μm. Thus, a lithographic plate material according to the present invention was obtained.

The surface of the image-receptive layer of the obtained lithographic plate material of the present invention showed an arithmetic mean roughness defined by JIS-B0601 of 0.9 μm and a contact angle to distilled water of 15° at room temperature. The surface resistivity of the low electric-resistance layer was $0.7\times10^8\Omega$.

Example 2

A lithographic plate material was obtained in the same manner as in Example 1 except that the amount of the silica (primary particle size: 12 nm, specific surface area according to BET method: 200 $m^2/g$) was changed to 3 parts and no alumina was used in the coating solution for the image-receptive layer.

The surface of the image-receptive layer of the obtained lithographic plate material showed an arithmetic mean roughness defined by JIS-B0601 of 0.9 $\mu$m and a contact angle to distilled water of 15° at room temperature.

Example 3

A lithographic plate material was obtained in the same manner as in Example 1 except that the silica (primary particle size: 12 nm, specific surface area according to BET method: 200 $m^2/g$) was not added and the amount of alumina was changed to 3 parts in the image-receptive layer.

The surface of the image-receptive layer of the obtained lithographic plate material showed an arithmetic mean roughness defined by JIS-B0601 of 0.9 $\mu$m and a contact angle to distilled water of 20° at room temperature.

Example 4

A lithographic plate material was obtained in the same manner as in Example 1 except that the coating solution for the low electric-resistance layer was omitted, i.e., the low electric-resistance layer was not provided.

The surface resistivity of the surface opposite the image-receptive layer surface was $10^{14}\Omega$ or more.

Comparative Example 1

A lithographic plate material was obtained in the same manner as in Example 1 except that no silica was added in the preparation of the coating solution for the undercoat layer and no silica (average particle size: 6 $\mu$m) was added in the preparation of the coating solution for the image-receptive layer.

The surface of the image-receptive layer of the thus obtained lithographic plate material showed an arithmetic mean roughness defined by JIS-B0601 of 0.25 $\mu$m and a contact angle to distilled water of 20° at room temperature.

Comparative Example 2

A lithographic plate material was obtained in the same manner as in Example 1 except that the amount of the silica was changed to 8 parts in the preparation of the coating solution for the undercoat layer.

The surface of the image-receptive layer of the thus obtained lithographic plate material showed an arithmetic mean roughness defined by JIS-B0601 of 1.5 $\mu$m and a contact angle to distilled water of less than 10° at room temperature.

Comparative Example 3

A coating solution for the image-receptive layer was prepared by dispersing the following materials in a ball mill for 3 days, was coated without providing an undercoat layer, and dried with hot air at 120° C. for 2 minutes to provide an image-receptive layer having a thickness of about 9 $\mu$m.

A low electric-resistance layer was provided in the same manner as in Example 1 to obtain a lithographic plate material.

Coating Solution for the Image-receptive Layer

| | |
|---|---|
| Polyester resin having terminal hydroxyl groups (Elitel UE3201, Unichika, Ltd.) | 5 parts |
| Zinc oxide (for wet electrophotography master, Sazex #2000, Sakai Chemical Industry Co., Ltd.) | 30 parts |
| Silica (average particle size: 3.0 $\mu$m, not subjected to any treatment, Sylysia 730, Fuji-Silysia Chemical Ltd.,) | 5 parts |
| Toluene | 48 parts |
| Methyl ethyl ketone | 12 parts |

The surface of the image-receptive layer of the obtained lithographic plate material showed an arithmetic mean roughness defined by JIS-B0601 of 0.8 $\mu$m and a contact angle to distilled water of 65° at room temperature.

The following evaluation was performed for the lithographic plate materials obtained in the above Examples 1–4 and Comparative Examples 1–3.

(1) Evaluation of Electrostatic Mounting of the Lithographic Plate Material

The lithographic plate materials obtained in the examples and comparative examples were each attached to an ink-jet printer utilizing hot melt type solid ink (Solid Ink-jet Plate Maker SJ02A, Hitachi Koki Co., Ltd.), and their electrostatic mounting was evaluated according to the following criteria. The results are shown in Table 1.

Evaluation Criteria

○: The lithographic plate material can be attached to a vertical flat mounting portion of the ink-jet printer without using any clamp or adhesive tape, and the material shows close contact with the surface without any gap and has no rubbing at the image-receiving surface with a recording head.

Δ: The lithographic plate material did not drop off the mounting portion, but showed a partial gap, and the recording head rubs the image-receiving surface so that images become partially defective.

x: The lithographic plate material dropped off the mounting portion, and therefore the material required attachment by using clamps or adhesive tape.

(2) Evaluation of Printability

Printing plates were prepared from the lithographic plate materials obtained in the examples and comparative examples by outputting 4–18 point characters of Mincho typeface and screen tint images with 80 lines of 20%, 40%, 60% and 80% as digital data using an ink-jet printer utilizing hot melt type solid ink (Solid Ink-jet Plate Maker SJ02A, Hitachi Koki Co., Ltd.). Since the lithographic plate material of Example 4 could not be attached to the printer by electrostatic attraction (chucking), the plate material was attached to the printer with an adhesive tape.

Printing was performed by using these printing plates under the following printing conditions without subjecting them to desensitization. Then, image reproducibility and scumming of the printed product were evaluated according to the following criteria (a) and (b). The results are shown in Table 1.

Printing Conditions

Printing machine: SPRINT26, KOMORI CORP.

Printing speed: 9000 sheets/hour

Paper: woodfree sheets

Ink: TK High Echo Sumi M: TOYO INK MFG. CO., LTD.

Fountain solution: PS Etch EU-3, Fuji Photo Film Co., Ltd., diluted 100 times with tap water (a) Evaluation of Image Reproducibility of Printed Matter
Evaluation criteria ○: Characters of 4–18 points in Mincho typeface and screen tint images with 80 lines of 20%, 40%, 60% and 80% had good resolution and reproduced very well, and no deletion of images is seen even when the number of printed sheets exceeds 5000.

Δ: Characters of 4 point in Mincho typeface and screen tint images with 80 lines of 20% are deleted from the beginning of printing, and resolution reproducibility of characters of 6 point or more in Mincho typeface and screen tint images with 80 lines of 40% or more becomes poor and images are partially deleted when the number of printed sheets exceeds 1000.

x: Deletion is observed for characters of 4–18 points in Mincho typeface and the whole area of screen tint images with 80 lines of 20%, 40%, 60% and 80% from the beginning of printing, and thus resolution reproducibility is poor.

(b) Evaluation of Scumming
Evaluation criteria

○: Scumming is not observed even when the number of printed sheets exceeds 5000.

Δ: Although scumming is not observed at the beginning of printing, scumming is generated in non-image areas and thus printing failure is caused when the number of printed sheets exceeds 1000.

x: Scumming is observed and printing failure is seen even at the beginning of printing.

TABLE 1

| | Electrostatic mounting | Image reproducibility | Scumming |
|---|---|---|---|
| Example 1 | ○ | ○ | ○ |
| Example 2 | ○ | Δ-○ | ○ |
| Example 3 | ○ | ○ | Δ-○ |
| Example 4 | x | ○ | ○ |
| Comparative Example 1 | ○ | Δ | Δ |
| Comparative Example 2 | ○ | x-Δ | Δ |
| Comparative Example 3 | ○ | x | x |

As seen from the above results, the lithographic plate material of the present invention and the method for making lithographic plates using the same enable use of ink-jet printers utilizing hot melt type solid ink, and can provide lithographic plates in which sufficiently desensitized surfaces can be obtained with distilled water or a fountain solution used for other lithographic plates, without desensitization treatment with an etching solution and without scumming, and provide superior printing durability.

What is claimed is:

1. A lithographic plate material comprising a support and an image-receptive layer formed on the support, wherein the surface of the image-receptive layer has an arithmetic mean roughness defined by JIS-B0601 of not less than 0.40 μm and less than 1.20 μm and a contact angle to distilled water at room temperature of less than 50 degrees, wherein the image-receptive layer has ink-receptiveness for hot-melt and lipophilic ink, and wherein the image-receptive layer comprises polyvinyl alcohol cross-linked with tetra-alkoxy silane hydroxylate, titanium oxide microparticles, and silica having an average primary particle size of from 1 nm to 100 nm and/or alumina having an average primary particle size of from 1 nm to 100 nm.

2. A lithographic plate material of claim 1 further comprising an undercoat layer between the support and the image-receptive layer.

3. A lithographic plate material of claim 2, wherein the undercoat layer contains inorganic microparticles or synthetic resin microparticles.

4. A method for making a lithographic plate comprising:

providing a lithographic plate material according to claim 1; and forming lipophilic images on the image-receiving layer using hot-melt and lipophilic ink.

5. A method for making a lithographic plate of claim 4 further comprising imparting water retention characteristics for a lithographic fountain solution to the image-receptive layer without desensitizing.

6. A method for making a lithographic plate of claim 4, wherein the lipophilic images are formed using an ink-jet printer utilizing hot-melt type solid ink.

7. A lithographic plate material comprising a support and an image-receptive layer formed on the support, wherein the image-receptive layer comprises polyvinyl alcohol cross-linked with tetra-alkoxy silane hydroxylate, titanium oxide microparticles, and silica having an average primary particle size of from 1 nm to 10 nm and/or alumina having an average primary particle size of from 1 nm to 100 nm, wherein the surface of the image-receptive layer has a contact angle to distilled water at room temperature of less than 50 degrees, and wherein the image-receptive layer has ink-receptiveness for hot-melt and lipophilic ink.

8. A lithographic plate material of claim 7 further comprising an undercoat layer between the support and the image-receptive layer.

9. A lithographic plate material of claim 8, wherein the undercoat layer contains inorganic microparticles or synthetic resin microparticles.

* * * * *